US008220476B2

(12) United States Patent
VanElverdinghe

(10) Patent No.: US 8,220,476 B2
(45) Date of Patent: Jul. 17, 2012

(54) FRAME STRUCTURE FOR A QUICKLY ERECTABLE CANOPY SHELTER

(76) Inventor: Jeffry L. VanElverdinghe, Dallas, OR (US)

( * ) Notice: Subject to any disclaimer, the term of this patent is extended or adjusted under 35 U.S.C. 154(b) by 119 days.

(21) Appl. No.: 12/726,328

(22) Filed: Mar. 17, 2010

(65) Prior Publication Data

US 2010/0236593 A1 Sep. 23, 2010

Related U.S. Application Data

(60) Provisional application No. 61/161,400, filed on Mar. 18, 2009, provisional application No. 61/165,808, filed on Apr. 1, 2009.

(51) Int. Cl.
*E04H 15/50* (2006.01)
*E04H 15/38* (2006.01)

(52) U.S. Cl. ..... 135/131; 135/145; 135/136; 135/147

(58) Field of Classification Search ..... 135/124, 135/125, 126, 128, 131, 135, 136, 143, 145, 135/147, 120.3
See application file for complete search history.

(56) References Cited

U.S. PATENT DOCUMENTS

| | | | | |
|---|---|---|---|---|
| 5,634,483 | A * | 6/1997 | Gwin | 135/131 |
| 6,470,902 | B1 * | 10/2002 | Carter | 135/145 |
| 6,779,538 | B2 * | 8/2004 | Morgante et al. | 135/128 |
| 2004/0020526 | A1 * | 2/2004 | Deng | 135/131 |
| 2007/0221262 | A1 * | 9/2007 | Tsai et al. | 135/145 |

* cited by examiner

*Primary Examiner* — David Dunn
*Assistant Examiner* — Danielle Jackson
(74) *Attorney, Agent, or Firm* — Joseph P. Curtin, L.L.C.

(57) ABSTRACT

A frame structure comprising a plurality of leg members, a plurality of top-corner fittings, a plurality of slide fittings and a plurality of flexible-pole members. Each leg member comprises a first end and a second end. A top-corner fitting is attached to the first end of each leg member. A slide fitting is coupled to each leg member and is adjustably movable along a length of the leg member between the first end and the second end of the leg member. Each flexible-pole member corresponds to a leg member, and each flexible-pole member comprises a first end and a second end. The first end of each flexible-pole member is coupled to a slide fitting, and a second end of each flexible-pole member is coupled to a central hub member. Each flexible-pole member forms an arching shape when the frame structure is in an erect, unfolded position.

6 Claims, 12 Drawing Sheets

FRAME STRUCTURE FOR A QUICKLY ERECTABLE CANOPY SHELTER

CROSS-REFERENCES TO RELATED PATENT APPLICATIONS

The present patent application claims priority to U.S. Provisional Patent Application Ser. No. 61/616,400, filed Mar. 18, 2009, entitled "Quickly Erectable Canopy Shelters," and invented by Jeffry L. VanElverdinghe, and to U.S. Provisional Patent Application Ser. No. 61/165,808, filed Apr. 1, 2009, entitled "Quickly Erectable Canopy Shelters," and invented by Jeffry L. VanElverdinghe, the disclosures of each being incorporated by reference herein. Additionally, the present patent application is related to U.S. Design patent application Ser. No. 29/334,009, entitled "Canopy Top Fitting," filed Mar. 18, 2009; U.S. Design patent application Ser. No. 29/344,010, entitled "Canopy Slide Fitting," filed Mar. 18, 2009; and U.S. Design patent application Ser. No. 29/344,011, entitled "Canopy Camlock Fitting," filed Mar. 18, 2009, the disclosures of each being incorporated by reference herein.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

Exemplary embodiments are illustrated in referenced figures of the drawings. It is intended that the embodiments and figures disclosed are to be considered illustrative rather than restrictive.

Figure 1A:
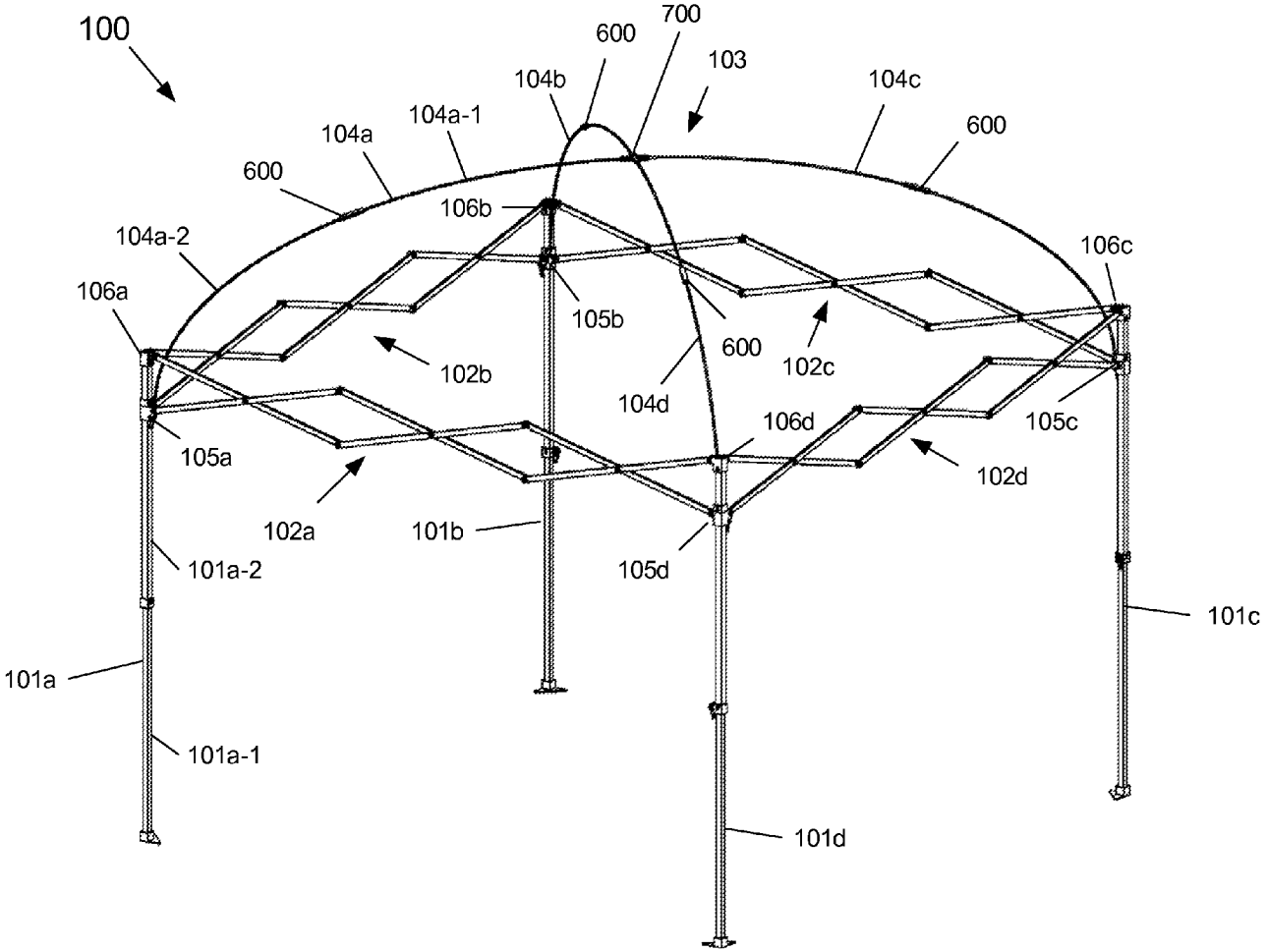
FIG. 1A depicts an isometric view of an exemplary embodiment of a quickly erectable canopy shelter with no parallel guides according to the subject matter disclosed herein.
Figure 1B:
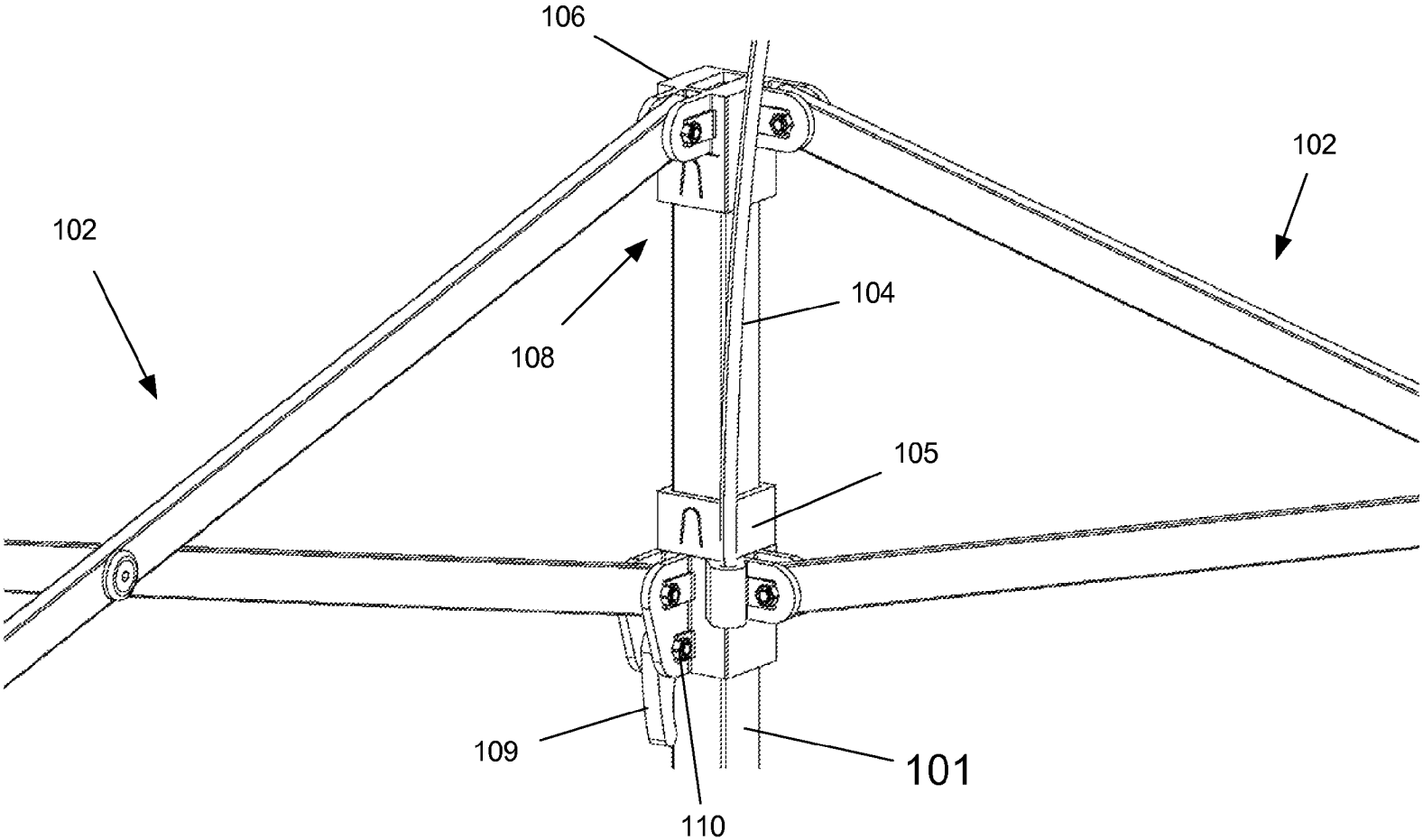
FIG. 1B depicts an isometric view providing greater detail of the exemplary embodiment of the quickly erectable canopy shelter with no parallel guides depicted in FIG. 1A according to the subject matter disclosed herein.

The subject matter disclosed herein relates to quickly erectable canopy shelters. FIG. 1A depicts an isometric view of an exemplary embodiment of a frame structure 100 for a quickly erectable canopy shelter according to the subject matter disclosed herein. FIG. 1B depicts an isometric view providing greater detail of the exemplary embodiment of frame structure 100 for the quickly erectable canopy shelter depicted in FIG. 1A according to the subject matter disclosed herein. Frame structure 100 comprises a plurality of legs 101*a*-101*d* connected together by an extendible perimeter assembly of link members 102*a*-102*d*. The roof structure 103 is formed by flexible pole members 104*a*-104*d*, each respectively rigidly connected at the lower end to a sliding member (or slide fitting) 105*a*-105*d*, comprising no parallel guides near the upper end of the respective leg members 101 at 108 (FIG. 1B).

In one exemplary embodiment, legs 101*a*-101*d* could be formed as a single-section leg. In another exemplary embodiment, one or more of legs 101*a*-101*d* could be formed from a plurality of leg-member sections. For example, in FIG. 1A, each of legs 101*a*-101*d* are depicted as being formed by two leg-member sections, of which only leg-member sections 101*a*-1 and 101*a*-2 are indicated for clarity. For the particular exemplary embodiment depicted in FIG. 1A, the leg-member sections forming a leg are coupled together in a well-known locking and telescoping manner. In one exemplary embodiment, each link member 102*a*-102*d* forming the extendible perimeter assembly of link members are coupled together to form a well-known scissors-joint arrangement between the tops of a pair of legs 101. For example, link member 102*a* is coupled between the tops of legs 101*a* and 101*d*, link member 102*b* is coupled between the tops of legs 101*a* and 101*b*, link member 102*c* is coupled between the tops of legs 101*b* and 101*c*, and link member 102*d* is coupled between the tops of legs 101*c* and 101*d*. It should be understood that a link member 102 could be selected to any number of scissors joint arrangements that would be suitable for a particular embodiment of frame structure 100.

Figure 6:
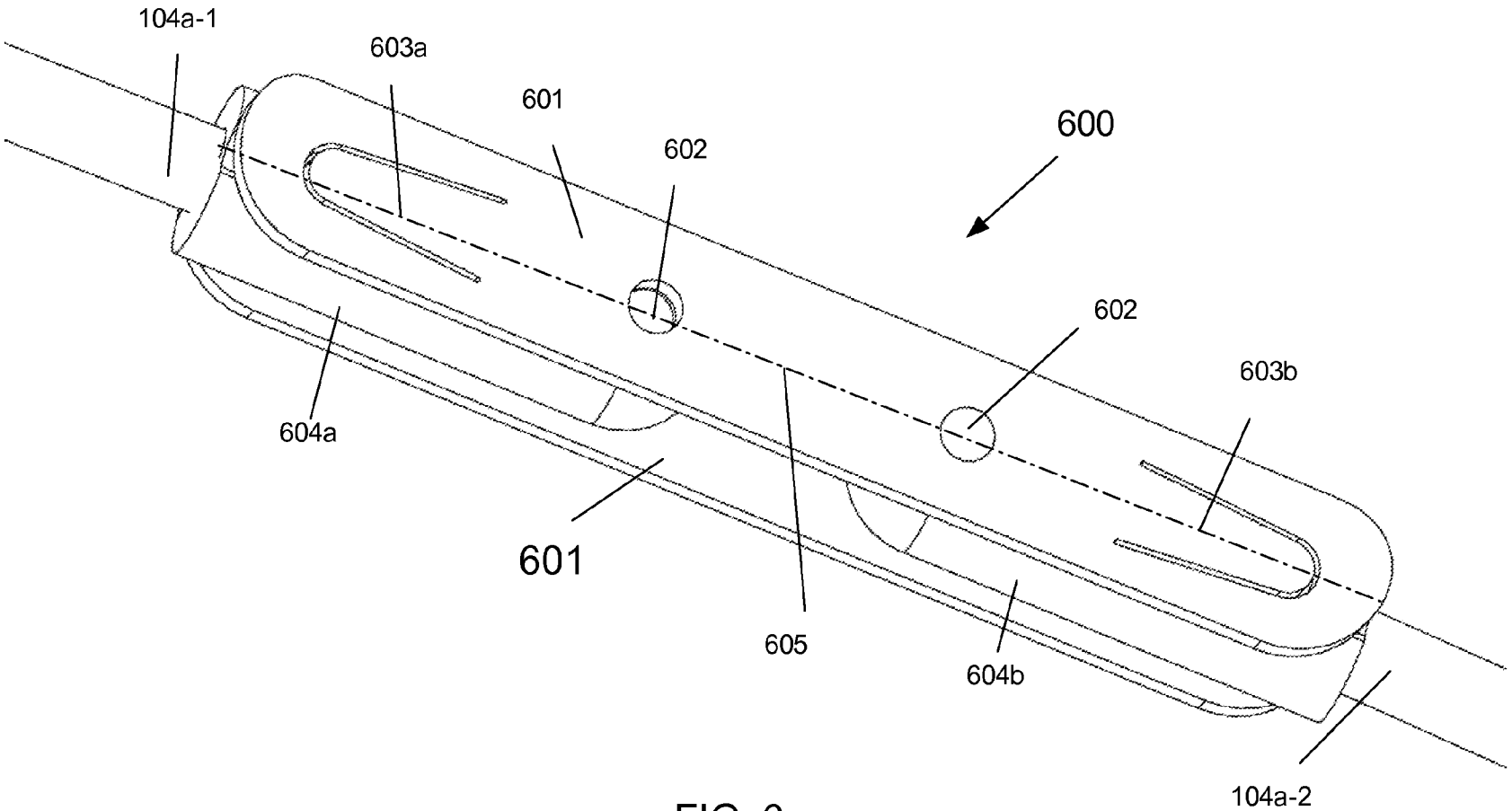
FIG. 6 depicts an isometric view of an exemplary embodiment of a mid-span folding fitting for a flexible member according to the subject matter disclosed herein.
Figure 7:
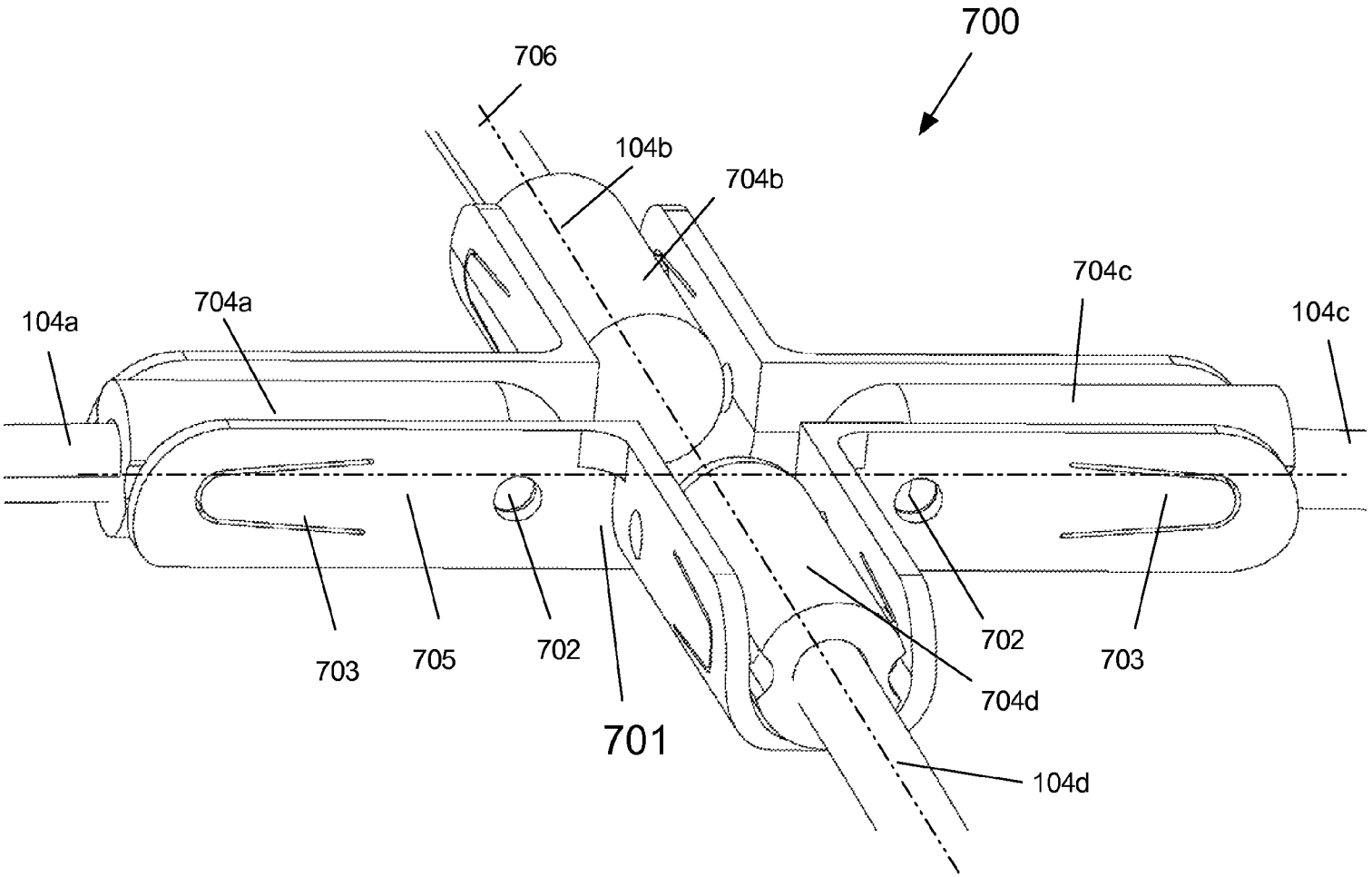
FIG. 7 depicts an isometric view of an exemplary embodiment of a central hub (or peak-folding fitting) for flexible members according to the subject matter disclosed herein.

In one exemplary embodiment, flexible pole-members 104*a*-104*d* forming roof structure 103 could be formed as single-section flexible poles. In another exemplary embodiment, one or more of flexible pole members 104*a*-104*d* could be formed from a plurality of flexible-pole-member sections that are pivotally joined by a mid-span folding fitting 600. For example, in FIG. 1A, each of flexible pole members 104*a*-104*d* are depicted as being formed by two flexible-pole-member sections, of which only flexible-pole-member sections 104*a*-1 and 104*a*-2 are indicated for clarity. One exemplary embodiment of a mid-span folding fitting 600 is depicted in FIG. 6. Flexible pole members 104*a*-104*d* are pivotally coupled to a central hub member (or peak-folding fitting) 700 at the upper end to extend across frame structure 100 from corner to corner. One exemplary embodiment of a central hub member (or peak-folding fitting) 700 is depicted in FIG. 7.

For the exemplary embodiment depicted in FIGS. 1A and 1B, top-corner fittings 106*a*-106*d* are fixably attached to the top end of legs 101*a*-101*d*. A top-corner fitting 106 comprises no guide members that would help guide a flexible-pole member 104 as the frame structure 100 is adjusted between an erected position, such as shown in FIG. 1A, and a folded, or lowered position. In one exemplary embodiment, flexible pole members 104*a*-104*d* are movable between a retracted position when frame structure 100 is in a folded, or lowered, position, and an extended, upwardly arching position or shape when frame structure 100 is in an erected position (FIG. 1A). Sliding members 105 travel in the lengthwise direction along legs 101 and are movable between the lowered and raised position of frame structure 100. The respective positions of the sliding members 105 can be infinitely adjustable along legs 101 by using a camlock fitting 109 (FIG. 1B), which are operable in a well-known manner around a pin 110 to tighten sliding member 105 around leg 101.

In one exemplary embodiment, each of the flexible pole members 104 is formed of flexible-pole member sections that are hinged at a mid-span folding fitting 600 (FIG. 6) to permit upward folding of a flexible-pole member section (i.e., flexible-pole member section 104*a*-2 in FIG. 1A) and downward folding of a flexible-pole member section (i.e., flexible-pole member section 104*a*-1 in FIG. 1A) between a raised, erect position and a folded, or lowered, position of frame structure 100. That is, to fold frame structure 100 from the raised, erect position to the folded, or lowered, position, camlock fittings 109 of each of sliding members 105 are released and the sliding members 105 are respectively repositioned down a leg 101. As sliding members 105 are repositioned downward along a leg 101, link members 102*a*-102*d* operate in a well-known scissors joint manner to bring legs 101*a*-101*d* toward each other in a well-known manner. Each flexible pole member 104*a*-104*d* is pivotally folded at mid-span folding fitting 600 so that the section of the flexible-pole member coupled to the sliding fitting is oriented upwardly and the section of the flexible-pole member coupled to central hub member (or peak-folding fitting) 700 is oriented downwardly toward to the ground. Each of the sections of the flexible-pole members coupled to the central hub member 700 is pivotally repositioned so that central hub member 700 is in the vicinity of the bottom of legs 101 when in the folded or lowered position. In one exemplary embodiment, the lower sections of legs 101*a*-101*d* are unlocked from a long, telescoped position and slid into the upper sections of the legs and locked. In the folded or lowered position, legs 101*a*-101*d* of frame structure 100 are unlocked from a long, telescoped position and slid into the upper sections of the legs and locked. In the raised position, flexible pole members 104 are able to deflect outwardly to absorb downward forces exerted on canopy (not shown) coupled to roof structure 103.

Figure 2A:
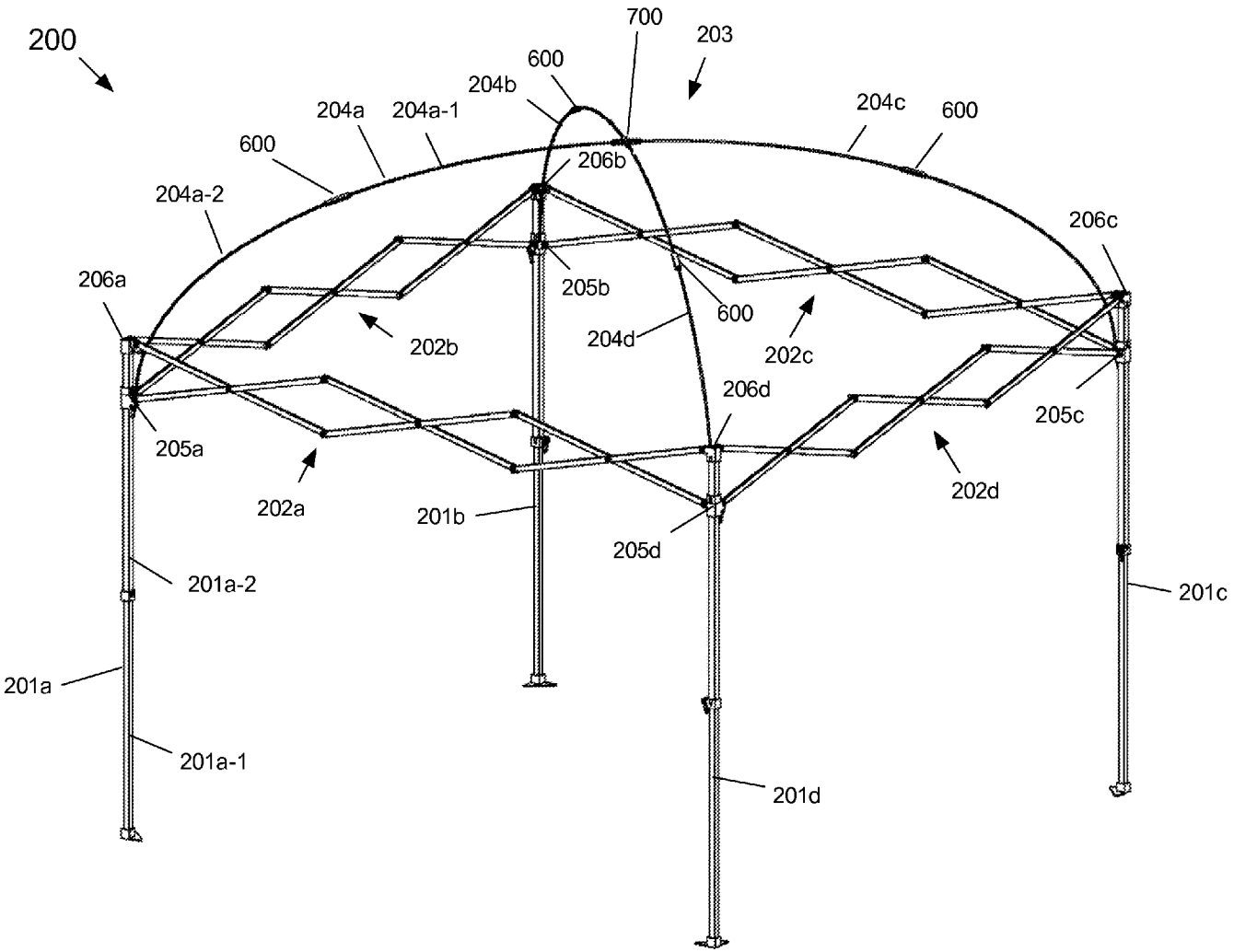
FIG. 2A depicts an isometric view of an exemplary embodiment of a quickly erectable canopy shelter comprising a top corner fitting having separate substantially parallel guides according to the subject matter disclosed herein.
Figure 2B:
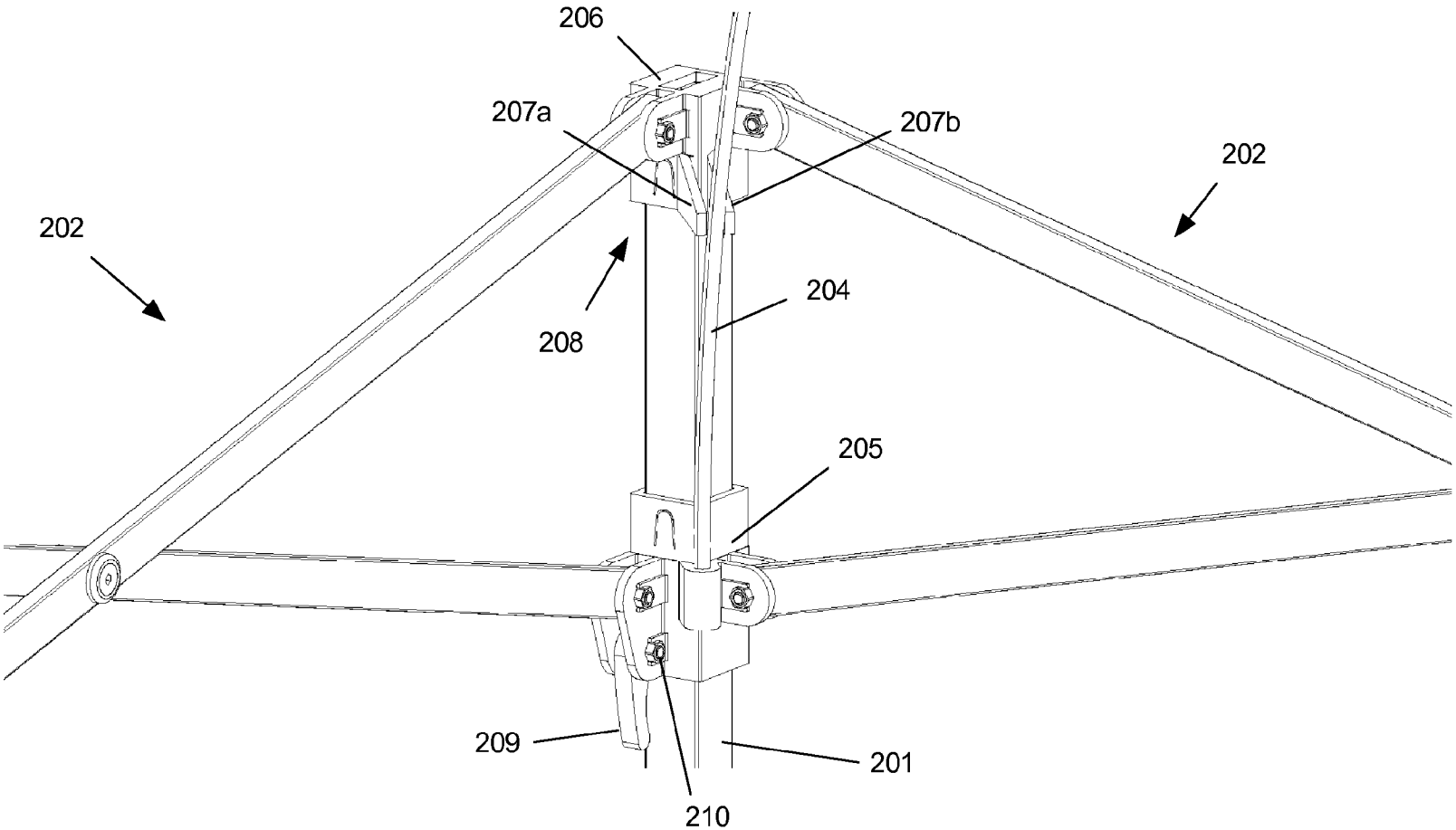
FIG. 2B depicts an isometric view providing greater detail of the exemplary embodiment of the quickly erectable canopy shelter comprising a top corner fitting having separate substantially parallel guides depicted in FIG. 2A according to the subject matter disclosed herein.

FIG. 2A depicts an isometric view of another exemplary embodiment of a frame structure 200 for a quickly erectable canopy shelter comprising a top corner fitting having separate substantially parallel guides according to the subject matter disclosed herein. FIG. 2B depicts an isometric view providing greater detail of the exemplary embodiment of frame structure 200 for a quickly erectable canopy shelter comprising a top corner fitting having separate substantially parallel guides according to the subject matter disclosed herein. Frame structure 200 comprises a plurality of legs 201*a*-201*d* connected together by an extendible perimeter assembly of link members 202*a*-202*d*. The roof structure 203 is formed by flexible pole members 204*a*-204*d*, each respectively rigidly connected at the lower end to a sliding member (or slide fitting) 205*a*-205*d*, comprising separate parallel guide members 207*a* and 207*b* near the upper end of the respective leg members 201 at 208 (FIG. 2B).

In one exemplary embodiment, legs 201*a*-201*d* could be formed as a single-section leg. In another exemplary embodiment, one or more of legs 201*a*-201*d* could be formed from a plurality of leg-member sections. For example, in FIG. 2A, each of legs 201*a*-201*d* are depicted as being formed by two leg-member sections, of which only leg-member sections 201*a*-1 and 201*a*-2 are indicated for clarity. For the particular exemplary embodiment depicted in FIG. 2A, the leg-member sections forming a leg are coupled together in a well-known locking and telescoping manner. In one exemplary embodiment, each link member 202*a*-202*d* forming the extendible perimeter assembly of link members are coupled together to form a well-known scissors-joint arrangement between the tops of a pair of legs 201. For example, link member 202*a* is coupled between the tops of legs 201*a* and 201*d*, link member 202*b* is coupled between the tops of legs 201*a* and 201*b*, link member 202*c* is coupled between the tops of legs 201*b* and 201*c*, and link member 202*d* is coupled between the tops of legs 201*c* and 201*d*. It should be understood that a link member 202 could be selected to any number of scissors joint arrangements that would be suitable for a particular embodiment of frame structure 200.

In one exemplary embodiment, flexible pole-members 204*a*-204*d* forming roof structure 203 could be formed as single-section flexible poles. In another exemplary embodiment, one or more of flexible pole members 204*a*-204*d* could be formed from a plurality of flexible-pole-member sections that are pivotally joined by a mid-span folding fitting 600. For example, in FIG. 2A, each of flexible pole members 204*a*-204*d* are depicted as being formed by two flexible-pole-member sections, of which only flexible-pole-member sections 204*a*-1 and 204*a*-2 are indicated for clarity. One exemplary embodiment of a mid-span folding fitting 600 is depicted in FIG. 6. Flexible pole members 204*a*-204*d* are pivotally coupled to a central hub member (or peak-folding fitting) 700 at the upper end to extend across frame structure 200 from corner to corner. One exemplary embodiment of a central hub member (or peak-folding fitting) 700 is depicted in FIG. 7.

For the exemplary embodiment depicted in FIGS. 2A and 2B, top-corner fittings 206*a*-206*d* are fixably attached to the top end of legs 201*a*-201*d*. A top-corner fitting 206 comprises substantially parallel guide members 207*a* and 207*b* (FIG. 2B). Guide members 207*a* and 207*b* help guide a flexible pole member 204, which fits between guide members 207*a* and 207*b*, and keep the flexible pole member is a correct position as the frame structure 200 is adjusted between an erected position, such as shown in FIG. 2A, and a folded, or lowered position. In one exemplary embodiment, flexible pole members 204*a*-204*d* are movable between a retracted position when frame structure 200 is in a folded, or lowered, position, and an extended, upwardly arching position or shape when frame structure 200 is in an erected position (FIG. 2A). Sliding members 205 travel in the lengthwise direction along legs 201 and are movable between the lowered and raised position of frame structure 200. The respective positions of the sliding members 205 can be infinitely adjustable along legs 201 by using a camlock fitting 209 (FIG. 2B), which are operable in a well-known manner around a pin 210 to tighten sliding member 205 around leg 201.

In one exemplary embodiment, each of the flexible pole members 204 is formed of flexible-pole member sections that are hinged at a mid-span folding fitting 600 (FIG. 6) to permit upward folding of a flexible-pole member section (i.e., flexible-pole member section 204*a*-2 in FIG. 2A) and downward folding of a flexible-pole member section (i.e., flexible-pole member section 204*a*-1 in FIG. 2A) between a raised, erect position and a folded, or lowered, position of frame structure 200. That is, to fold frame structure 200 from the raised, erect position to the folded, or lowered, position, camlock fittings 209 of each of sliding members 205 are released and the sliding members 205 are respectively repositioned down a leg 201. As sliding members 205 are repositioned downward along a leg 201, link members 202*a*-202*d* operate in a well-known scissors joint manner to bring legs 201*a*-201*d* toward each other in a well-known manner. Each flexible pole member 204*a*-204*d* is pivotally folded at mid-span folding fitting 600 so that the section of the flexible-pole member coupled to the sliding fitting is oriented upwardly and the section of the flexible-pole member coupled to central hub member (or peak-folding fitting) 700 is oriented downwardly toward to the ground. Each of the sections of the flexible-pole members coupled to the central hub member 700 is pivotally repositioned so that central hub member 700 is in the vicinity of the bottom of legs 201 when in the folded or lowered position. In one exemplary embodiment, the lower sections of legs 201*a*-201*d* are unlocked from a long, telescoped position and slid into the upper sections of the legs and locked. In the raised position, flexible pole members 204 are able to deflect outwardly to absorb downward forces exerted on canopy (not shown) coupled to roof structure 203.

Figure 3A:
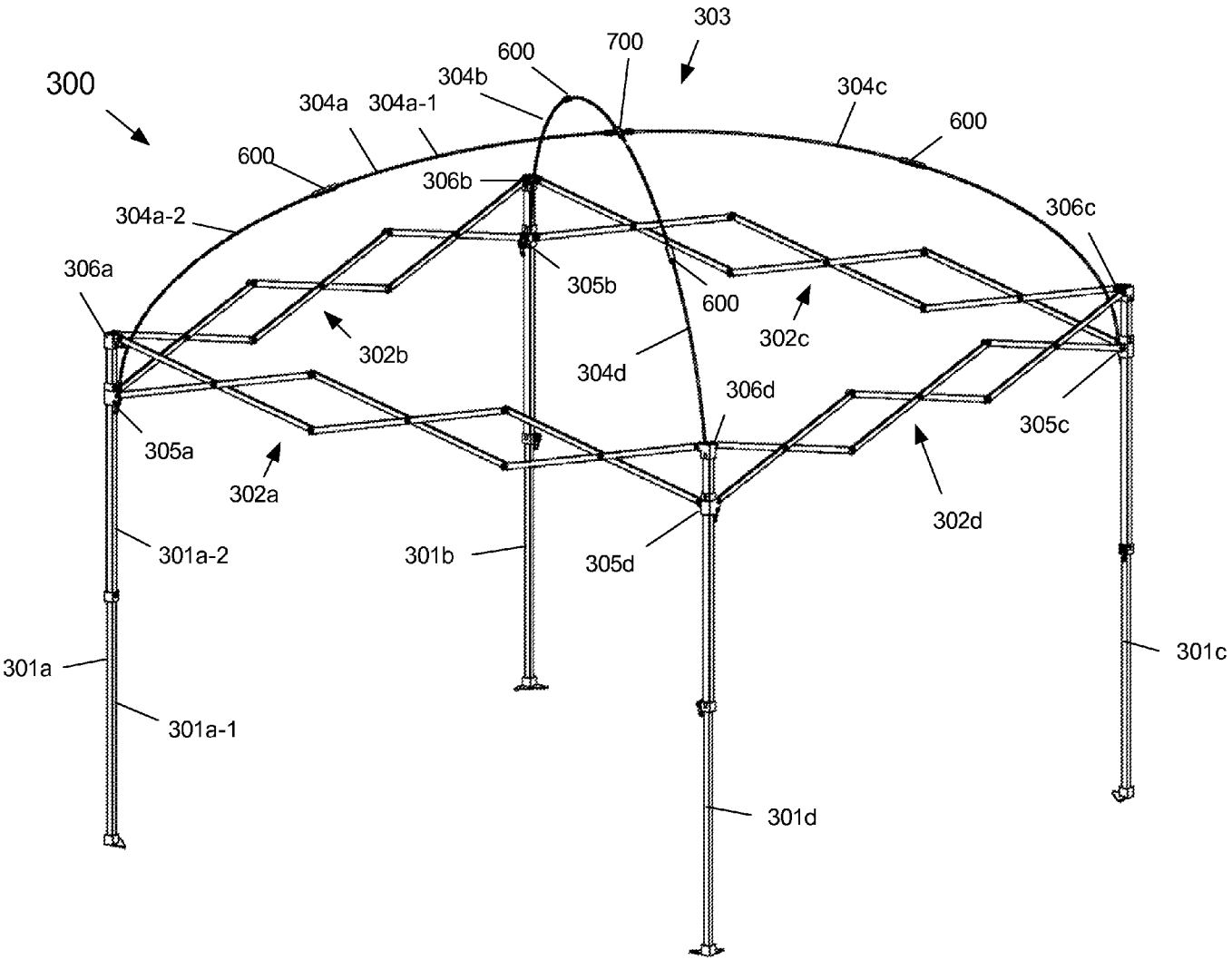
FIG. 3A depicts an isometric view of an exemplary embodiment of a quickly erectable canopy shelter comprising top-corner fitting having a hook-loop guide with an opening and substantially parallel sides according to the subject matter disclosed herein.
Figure 3B:
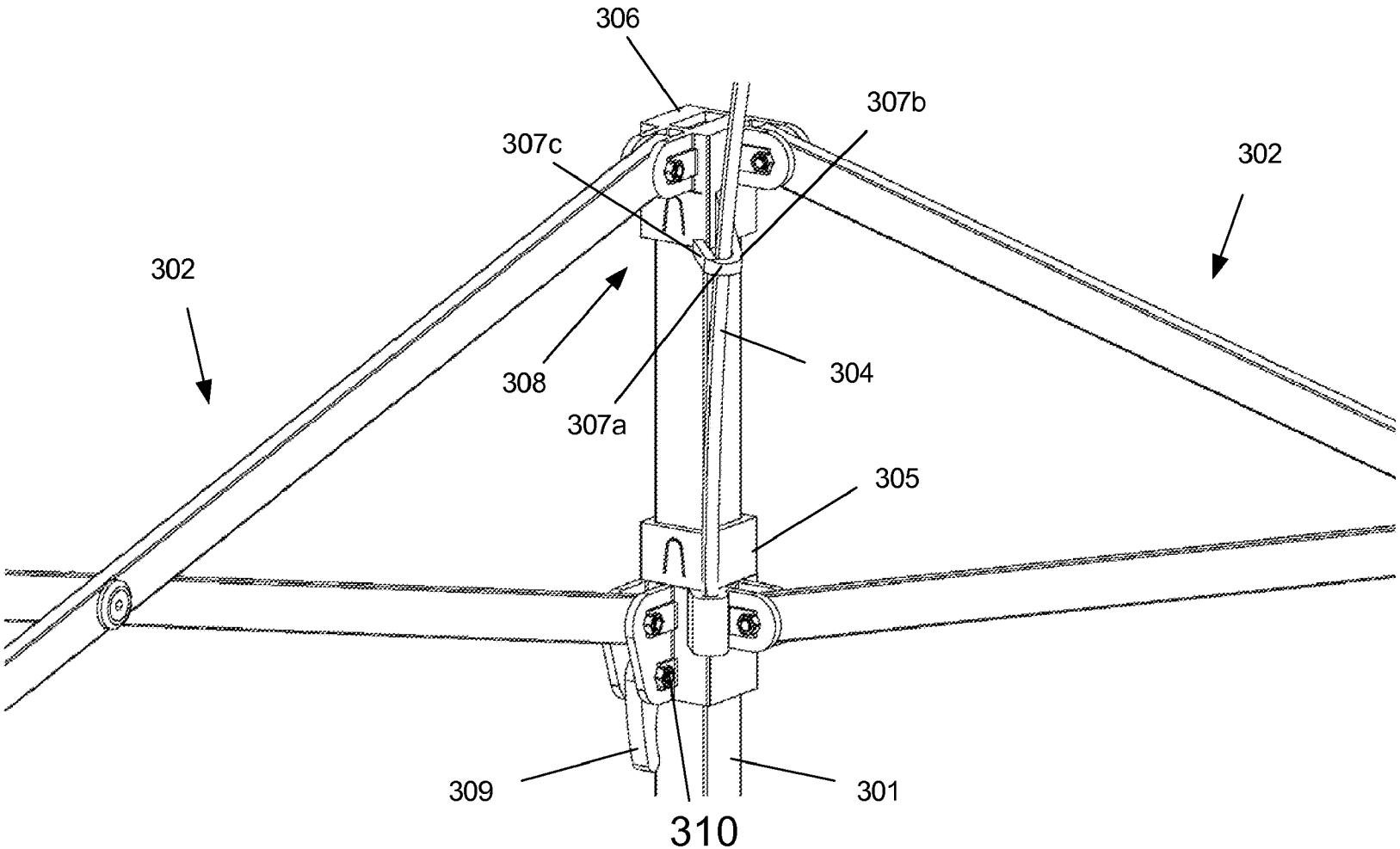
FIG. 3B depicts an isometric view providing greater detail of the exemplary embodiment of the quickly erectable canopy shelter comprising top-corner fitting having a hook-loop guide with an opening and substantially parallel sides depicted in FIG. 3A according to the subject matter disclosed herein.

FIG. 3A depicts an isometric view of an exemplary embodiment of a quickly erectable canopy shelter comprising top-corner fitting having a hook-loop guide with an opening and substantially parallel sides according to the subject matter disclosed herein. FIG. 3B depicts an isometric view providing greater detail of the exemplary embodiment of the quickly erectable canopy shelter comprising top-corner fitting having a hook-loop guide with an opening and substantially parallel sides depicted in FIG. 3A according to the subject matter disclosed herein. Frame structure 300 comprises a plurality of legs 301*a*-301*d* connected together by an extendible perimeter assembly of link members 302*a*-302*d*. The roof structure 303 is formed by flexible pole members 304*a*-304*d*, each respectively rigidly connected at the lower end to a sliding member (or slide fitting) 305*a*-305*d*, comprising a hook-loop guide 306 with an opening 307*a* and sides 307*b* and 307*c* that are substantially parallel near the upper end of the respective leg members 301 at 308 (FIG. 3B).

In one exemplary embodiment, legs 301*a*-301*d* could be formed as a single-section leg. In another exemplary embodiment, one or more of legs 301*a*-301*d* could be formed from a plurality of leg-member sections. For example, in FIG. 3A, each of legs 301*a*-301*d* are depicted as being formed by two leg-member sections, of which only leg-member sections 301*a*-1 and 301*a*-2 are indicated for clarity. For the particular exemplary embodiment depicted in FIG. 3A, the leg-member sections forming a leg are coupled together in a well-known locking and telescoping manner. In one exemplary embodiment, each link member 302*a*-302*d* forming the extendible perimeter assembly of link members are coupled together to form a well-known scissors-joint arrangement between the tops of a pair of legs 301. For example, link member 302*a* is coupled between the tops of legs 301*a* and 301*d*, link member 302*b* is coupled between the tops of legs 301*a* and 301*b*, link member 302*c* is coupled between the tops of legs 301*b* and 301*c*, and link member 302*d* is coupled between the tops of legs 301*c* and 301*d*. It should be understood that a link member 302 could be selected to any number of scissors joint arrangements that would be suitable for a particular embodiment of frame structure 300.

In one exemplary embodiment, flexible pole-members 304*a*-304*d* forming roof structure 303 could be formed as single-section flexible poles. In another exemplary embodiment, one or more of flexible pole members 304*a*-304*d* could be formed from a plurality of flexible-pole-member sections that are pivotally joined by a mid-span folding fitting 600. For example, in FIG. 3A, each of flexible pole members 304*a*-304*d* are depicted as being formed by two flexible-pole-member sections, of which only flexible-pole-member sections 304*a*-1 and 304*a*-2 are indicated for clarity. One exemplary embodiment of a mid-span folding fitting 600 is depicted in FIG. 6. Flexible pole members 304*a*-304*d* are pivotally coupled to a central hub member (or peak-folding fitting) 700 at the upper end to extend across frame structure 300 from corner to corner. One exemplary embodiment of a central hub member (or peak-folding fitting) 700 is depicted in FIG. 7.

For the exemplary embodiment depicted in FIGS. 3A and 3B, top-corner fittings 306*a*-306*d* are fixably attached to the top end of legs 301*a*-301*d*. A top-corner fitting 306 comprises a hook-loop guide 307 with side members 307*a* and 307*b* and an opening 307*c* in side member 307*a*. Side member 307*a* and 307*b* are substantially parallel (FIG. 3B). Side members 307*a* and 307*b* help guide a flexible pole member 304, which fits between into opening 307*c* of hook-loop guide 307, and keep the flexible pole member is a correct position as the frame structure 300 is adjusted between an erected position, such as shown in FIG. 3A, and a folded, or lowered position. In one exemplary embodiment, flexible pole members 304*a*-304*d* are movable between a refracted position when frame structure 300 is in a folded, or lowered, position, and an extended, upwardly arching position or shape when frame structure 300 is in an erected position (FIG. 3A). Sliding members 305 travel in the lengthwise direction along legs 301 and are movable between the lowered and raised position of frame structure 300. The respective positions of the sliding members 305 can be infinitely adjustable along legs 301 by using a camlock fitting 309 (FIG. 3B), which are operable in a well-known manner around a pin 310 to tighten sliding member 305 around leg 301.

In one exemplary embodiment, each of the flexible pole members 304 is formed of flexible-pole member sections that are hinged at a mid-span folding fitting 600 (FIG. 6) to permit upward folding of a flexible-pole member section (i.e., flexible-pole member section 304*a*-2 in FIG. 3A) and downward folding of a flexible-pole member section (i.e., flexible-pole member section 304*a*-1 in FIG. 3A) between a raised, erect position and a folded, or lowered, position of frame structure 300. That is, to fold frame structure 300 from the raised, erect position to the folded, or lowered, position, camlock fittings 309 of each of sliding members 305 are released and the sliding members 305 are respectively repositioned down a leg 301. As sliding members 305 are repositioned downward along a leg 301, link members 302*a*-302*d* operate in a well-known scissors joint manner to bring legs 301*a*-301*d* toward each other in a well-known manner. Each flexible pole member 304*a*-304*d* is pivotally folded at mid-span folding fitting 600 so that the section of the flexible-pole member coupled to the sliding fitting is oriented upwardly and the section of the flexible-pole member coupled to central hub member (or peak-folding fitting) 700 is oriented downwardly toward to the ground. Each of the sections of the flexible-pole members coupled to the central hub member 700 is pivotally repositioned so that central hub member 700 is in the vicinity of the bottom of legs 301 when in the folded or lowered position. In one exemplary embodiment, the lower sections of legs 301*a*-301*d* are unlocked from a long, telescoped position and slid into the upper sections of the legs and locked. In the folded or lowered position, legs 301*a*-301*d* of frame structure 300 are unlocked from a long, telescoped position and slid into the upper sections of the legs and locked. In the raised position, flexible pole members 304 are able to deflect outwardly to absorb downward forces exerted on canopy (not shown) coupled to roof structure 303.

Figure 4A:
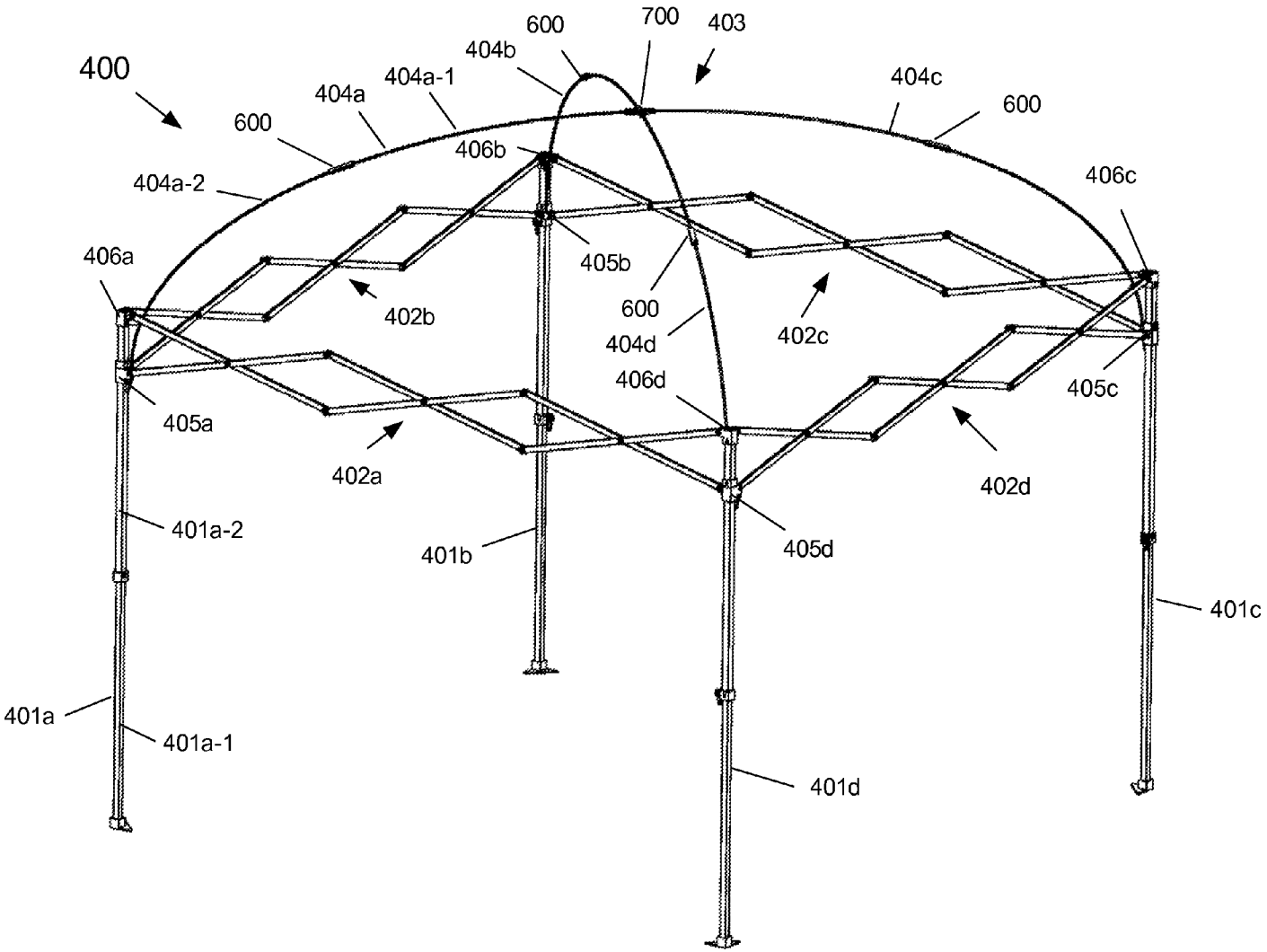
FIG. 4A depicts an isometric view of an exemplary embodiment of a quickly erectable canopy shelter comprising a closed loop guide with substantially parallel side members forming a narrow oval orifice near a top fitting assembly according to the subject matter disclosed herein.
Figure 4B:
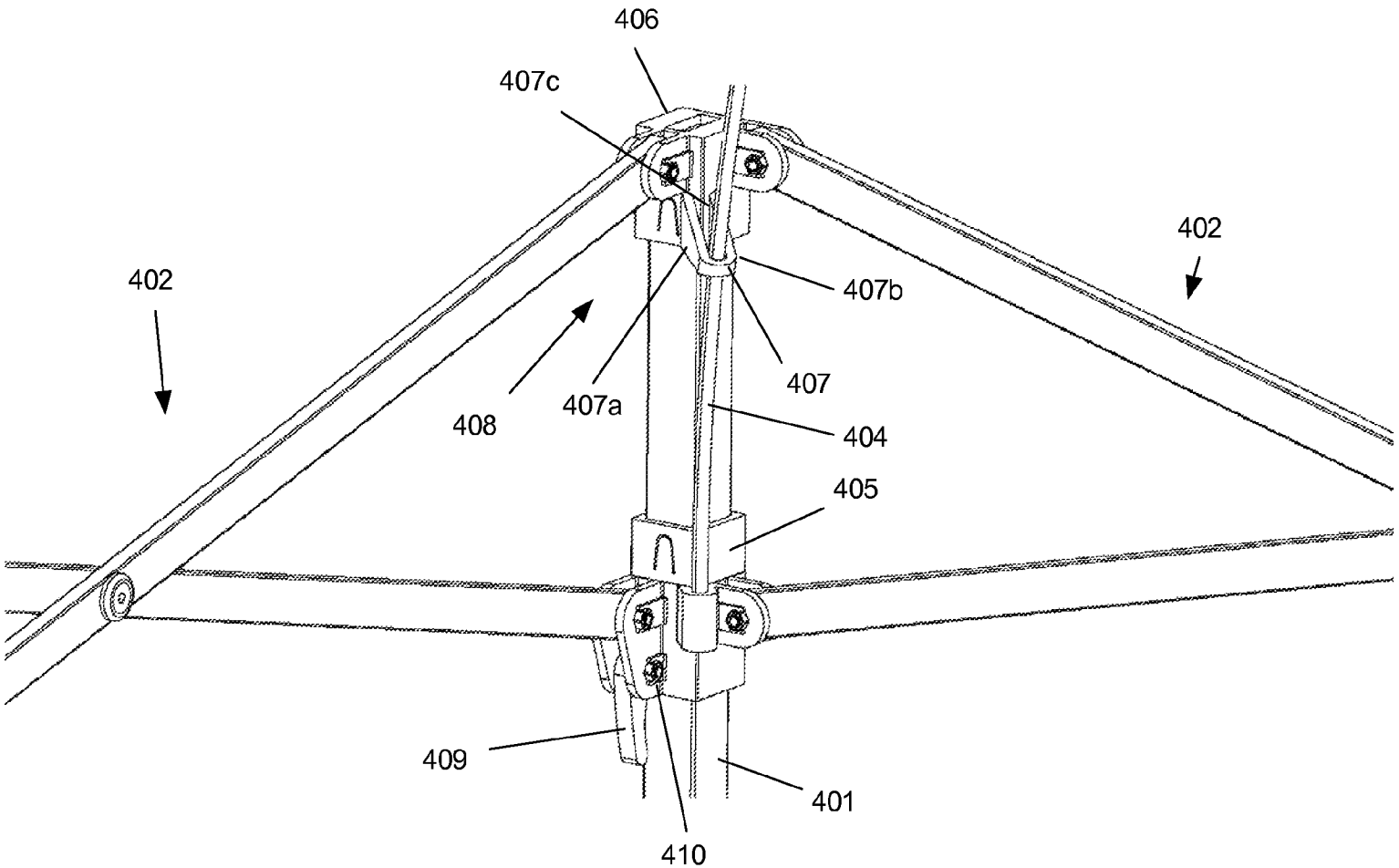
FIG. 4B depicts an isometric view providing greater detail of the exemplary embodiment of the quickly erectable canopy shelter comprising a closed loop guide with substantially parallel side members forming a narrow oval orifice near the top fitting assembly depicted in FIG. 4A according to the subject matter disclosed herein.

FIG. 4A depicts an isometric view of an exemplary embodiment of a quickly erectable canopy shelter comprising a closed loop guide with substantially parallel side members forming a narrow oval orifice near a top fitting assembly according to the subject matter disclosed herein. FIG. 4B depicts an isometric view providing greater detail of the exemplary embodiment of the quickly erectable canopy shelter comprising a closed loop guide with substantially parallel side members forming a narrow oval orifice near the top fitting assembly depicted in FIG. 4A according to the subject matter disclosed herein. Frame structure 400 comprises a plurality of legs 401*a*-401*d* connected together by an extendible perimeter assembly of link members 402*a*-402*d*. The roof structure 403 is formed by flexible pole members 404*a*-404*d*, each respectively rigidly connected at the lower end to a sliding member (or slide fitting) 405*a*-405*d*, comprising no open parallel guides like open parallel sides 207*a* and 207*b* (FIG. 2B) near the upper end of the respective leg members 401 at 408 (FIG. 4B).

In one exemplary embodiment, legs 401*a*-401*d* could be formed as a single-section leg. In another exemplary embodiment, one or more of legs 401*a*-401*d* could be formed from a plurality of leg-member sections. For example, in FIG. 4A, each of legs 401*a*-401*d* are depicted as being formed by two leg-member sections, of which only leg-member sections 401*a*-1 and 401*a*-2 are indicated for clarity. For the particular exemplary embodiment depicted in FIG. 4A, the leg-member sections forming a leg are coupled together in a well-known locking and telescoping manner. In one exemplary embodiment, each link member 402*a*-402*d* forming the extendible perimeter assembly of link members are coupled together to form a well-known scissors-joint arrangement between the tops of a pair of legs 401. For example, link member 402*a* is coupled between the tops of legs 401*a* and 401*d*, link member 402*b* is coupled between the tops of legs 401*a* and 401*b*, link member 402*c* is coupled between the tops of legs 401*b* and 401*c*, and link member 402*d* is coupled between the tops of legs 401*c* and 401*d*. It should be understood that a link member 402 could be selected to any number of scissors joint arrangements that would be suitable for a particular embodiment of frame structure 400.

In one exemplary embodiment, flexible pole-members 404*a*-404*d* forming roof structure 403 could be formed as single-section flexible poles. In another exemplary embodiment, one or more of flexible pole members 404*a*-404*d* could be formed from a plurality of flexible-pole-member sections that are pivotally joined by a mid-span folding fitting 600. For example, in FIG. 4A, each of flexible pole members 404*a*-404*d* are depicted as being formed by two flexible-pole-member sections, of which only flexible-pole-member sections 404*a*-1 and 404*a*-2 are indicated for clarity. One exemplary embodiment of a mid-span folding fitting 600 is depicted in FIG. 6. Flexible pole members 404*a*-404*d* are pivotally coupled to a central hub member (or peak-folding fitting) 700 at the upper end to extend across frame structure 400 from corner to corner. One exemplary embodiment of a central hub member (or peak-folding fitting) 700 is depicted in FIG. 7.

For the exemplary embodiment depicted in FIGS. 4A and 4B, top-corner fittings 406*a*-406*d* are fixably attached to the top end of legs 401*a*-401*d*. A top-corner fitting 406 comprises a closed loop guide 407 having substantially parallel side members 407*a* and 407*b* forming a narrow oval orifice 407*c* (FIG. 4B). A flexible-pole member 404 fits inside of orifice 407*c* and side members 407*a* and 407*b* help guide the flexible pole member 204 and keep the flexible pole member is a correct position as the frame structure 400 is adjusted between an erected position, such as shown in FIG. 4A, and a folded, or lowered position. It should be understood that orifice 407*c* could comprise a different shape in another exemplary embodiment. In one exemplary embodiment, flexible pole members 404*a*-404*d* are movable between a retracted position when frame structure 400 is in a folded, or lowered, position, and an extended, upwardly arching position or shape when frame structure 400 is in an erected position (FIG. 4A). Sliding members 405 travel in the lengthwise direction along legs 401 and are movable between the lowered and raised position of frame structure 400. The respective positions of the sliding members 405 can be infinitely adjustable along legs 401 by using a camlock fitting 409 (FIG. 4B), which are operable in a well-known manner around a pin 410 to tighten sliding member 405 around leg 401.

In one exemplary embodiment, each of the flexible pole members 404 is formed of flexible-pole member sections that are hinged at a mid-span folding fitting 600 (FIG. 6) to permit upward folding of a flexible-pole member section (i.e., flexible-pole member section 404*a*-2 in FIG. 4A) and downward folding of a flexible-pole member section (i.e., flexible-pole member section 404*a*-1 in FIG. 4A) between a raised, erect position and a folded, or lowered, position of frame structure 400. That is, to fold frame structure 400 from the raised, erect position to the folded, or lowered, position, camlock fittings 409 of each of sliding members 405 are released and the sliding members 405 are respectively repositioned down a leg 401. As sliding members 405 are repositioned downward along a leg 401, link members 402*a*-402*d* operate in a well-known scissors joint manner to bring legs 401*a*-401*d* toward each other in a well-known manner. Each flexible pole member 404*a*-404*d* is pivotally folded at mid-span folding fitting 600 so that the section of the flexible-pole member coupled to the sliding fitting is oriented upwardly and the section of the flexible-pole member coupled to central hub member (or peak-folding fitting) 700 is oriented downwardly toward to the ground. Each of the sections of the flexible-pole members coupled to the central hub member 700 is pivotally repositioned so that central hub member 700 is in the vicinity of the bottom of legs 401 when in the folded or lowered position. In one exemplary embodiment, the lower sections of legs 401*a*-401*d* are unlocked from a long, telescoped position and slid into the upper sections of the legs and locked. In the folded or lowered position, legs 401*a*-401*d* of frame structure 400 are unlocked from a long, telescoped position and slid into the upper sections of the legs and locked. In the raised position, flexible pole members 404 are able to deflect outwardly to absorb downward forces exerted on canopy (not shown) coupled to roof structure 403.

Figure 5A:
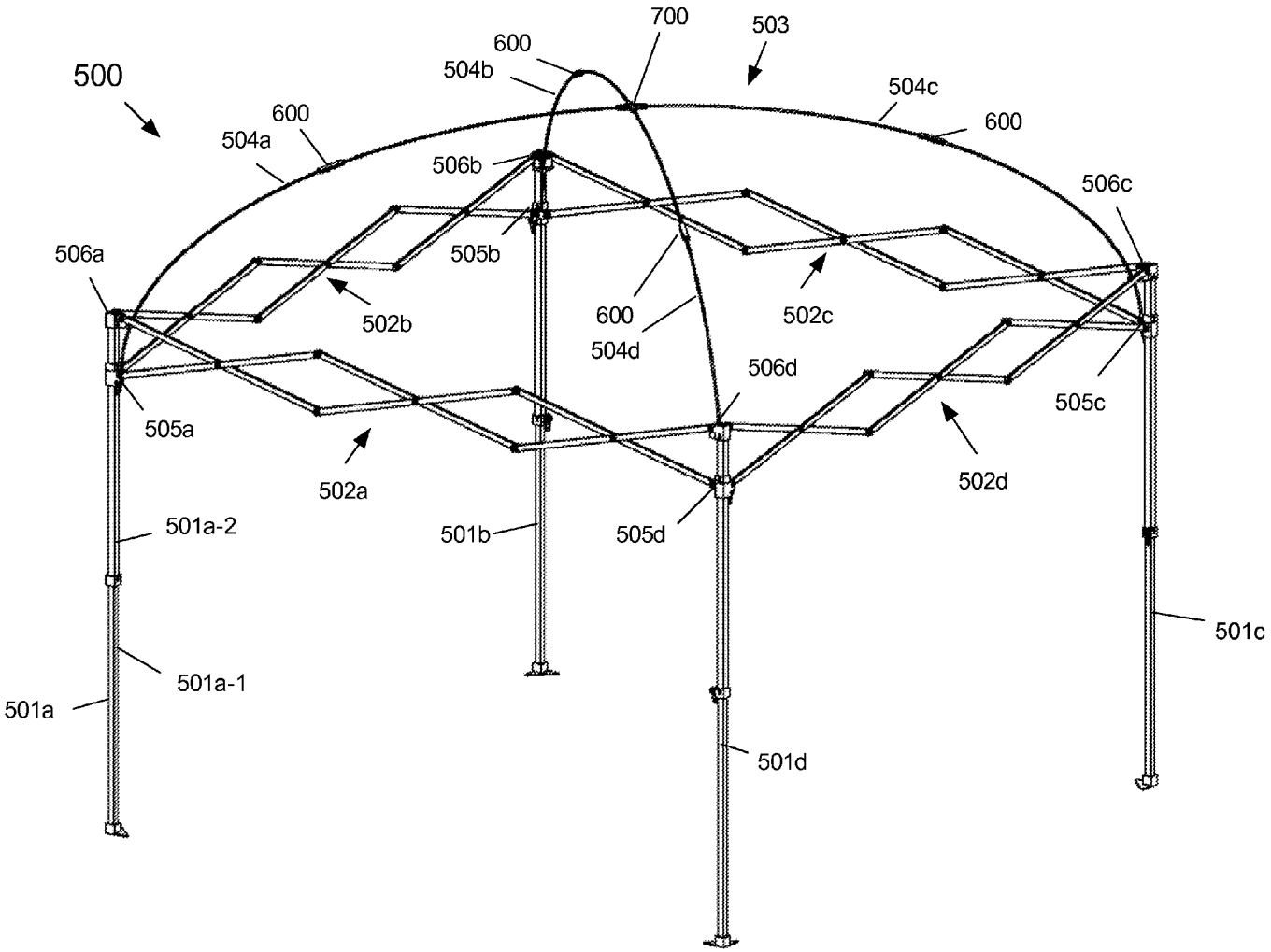
FIG. 5A depicts an isometric view of an exemplary embodiment of a quickly erectable canopy shelter comprising a top-corner fitting with a closed-loop guide with substantially perpendicularly oriented side members forming a large orifice according to the subject matter disclosed herein.
Figure 5B:
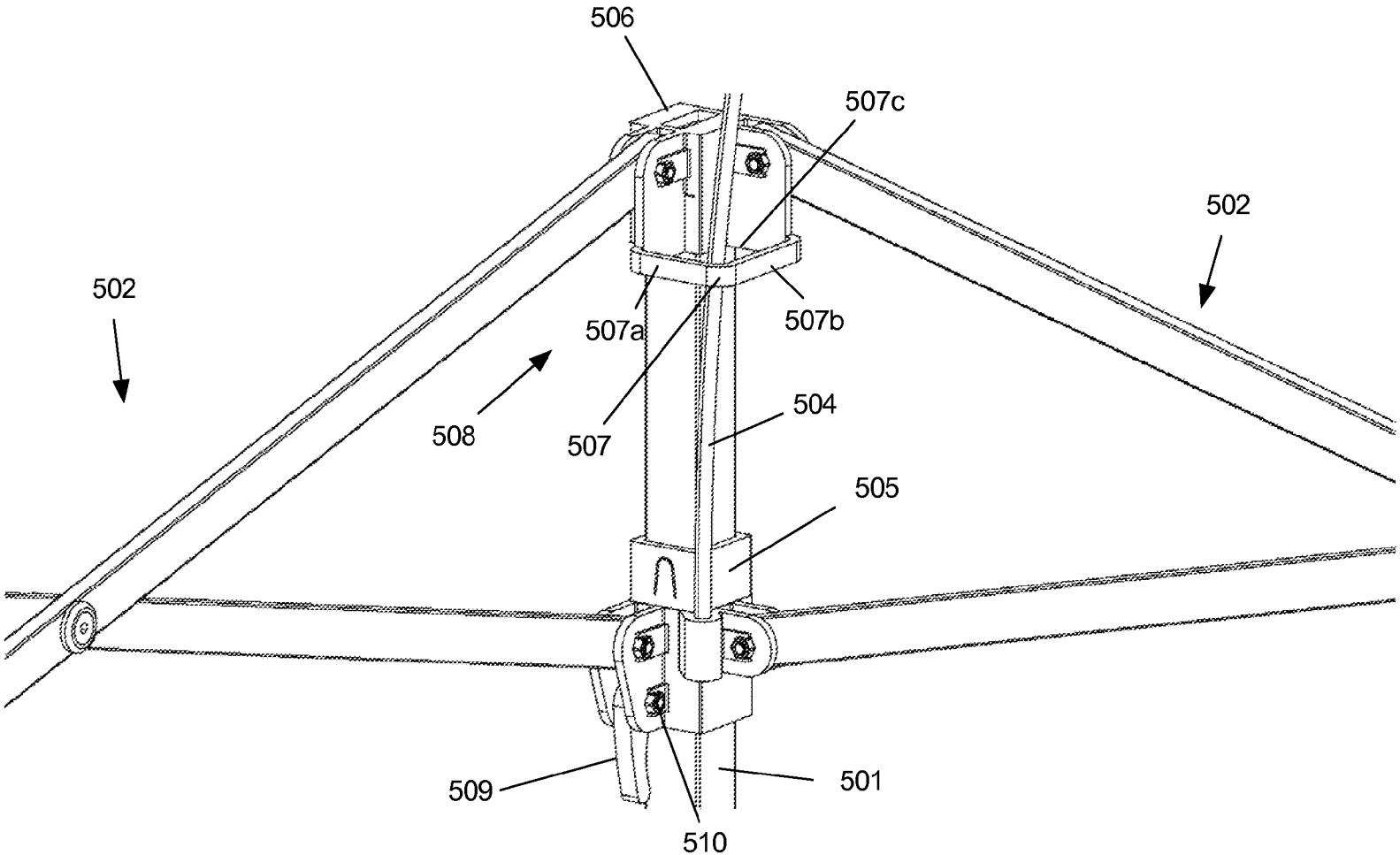
FIG. 5B depicts an isometric view providing greater detail of the exemplary embodiment of the quickly erectable canopy shelter comprising a top-corner fitting with a closed-loop guide with substantially perpendicularly oriented side members forming a large orifice depicted in FIG. 5A according to the subject matter disclosed herein.

FIG. 5A depicts an isometric view of an exemplary embodiment of a quickly erectable canopy shelter comprising a top-corner fitting with a closed-loop guide with substantially perpendicularly oriented sides forming a large orifice according to the subject matter disclosed herein. FIG. 5B depicts an isometric view providing greater detail of the exemplary embodiment of the quickly erectable canopy shelter comprising a top-corner fitting with a closed-loop guide with substantially perpendicularly oriented sides forming a large orifice depicted in FIG. 5A according to the subject matter disclosed herein. Frame structure 500 comprises a plurality of legs 501*a*-501*d* connected together by an extendible perimeter assembly of link members 502*a*-502*d*. The roof structure 503 is formed by flexible pole members 504*a*-504*d*, each respectively rigidly connected at the lower end to a sliding member (or slide fitting) 505*a*-505*d*, comprising no parallel guides near the upper end of the respective leg members 501 at 108 (FIG. 5B).

In one exemplary embodiment, legs 501*a*-501*d* could be formed as a single-section leg. In another exemplary embodiment, one or more of legs 501*a*-501*d* could be formed from a plurality of leg-member sections. For example, in FIG. 5A, each of legs 501*a*-501*d* are depicted as being formed by two leg-member sections, of which only leg-member sections 501*a*-1 and 501*a*-2 are indicated for clarity. For the particular exemplary embodiment depicted in FIG. 5A, the leg-member sections forming a leg are coupled together in a well-known locking and telescoping manner. In one exemplary embodiment, each link member 502*a*-502*d* forming the extendible perimeter assembly of link members are coupled together to form a well-known scissors-joint arrangement between the tops of a pair of legs 501. For example, link member 502*a* is coupled between the tops of legs 501*a* and 501*d*, link member 502*b* is coupled between the tops of legs 501*a* and 501*b*, link member 502*c* is coupled between the tops of legs 501*b* and 501*c*, and link member 502*d* is coupled between the tops of legs 501*c* and 501*d*. It should be understood that a link member 502 could be selected to any number of scissors joint arrangements that would be suitable for a particular embodiment of frame structure 500.

In one exemplary embodiment, flexible pole-members 504*a*-504*d* forming roof structure 503 could be formed as single-section flexible poles. In another exemplary embodiment, one or more of flexible pole members 504*a*-504*d* could be formed from a plurality of flexible-pole-member sections that are pivotally joined by a mid-span folding fitting 600. For example, in FIG. 5A, each of flexible pole members 504*a*-504*d* are depicted as being formed by two flexible-pole-member sections, of which only flexible-pole-member sections 504*a*-1 and 504*a*-2 are indicated for clarity. One exemplary embodiment of a mid-span folding fitting 600 is depicted in FIG. 6. Flexible pole members 504*a*-504*d* are pivotally coupled to a central hub member (or peak-folding fitting) 700 at the upper end to extend across frame structure 100 from corner to corner. One exemplary embodiment of a central hub member (or peak-folding fitting) 700 is depicted in FIG. 7.

For the exemplary embodiment depicted in FIGS. 5A and 5B, top-corner fittings 506*a*-506*d* are fixably attached to the top end of legs 501*a*-501*d*. A top-corner fitting 506 comprises a top-corner fitting 506 having a closed-loop guide 507 with substantially perpendicularly oriented side members 507*a* and 507*b* forming a large orifice 507*c*. A flexible-pole member 504 fits inside of orifice 507*c* and side members 507*a* and 507*b* help guide the flexible pole member 504 and keep the flexible pole member is a correct position as the frame structure 500 is adjusted between an erected position, such as shown in FIG. 5A, and a folded, or lowered position. It should be understood that orifice 507*c* could comprise a different shape in another exemplary embodiment. In one exemplary embodiment, flexible pole members 504*a*-504*d* are movable between a refracted position when frame structure 500 is in a folded, or lowered, position, and an extended, upwardly arching position or shape when frame structure 500 is in an erected position (FIG. 5A). Sliding members 505 travel in the lengthwise direction along legs 501 and are movable between the lowered and raised position of frame structure 500. The respective positions of the sliding members 505 can be infinitely adjustable along legs 501 by using a camlock fitting 509 (FIG. 5B), which are operable in a well-known manner around a pin 510 to tighten sliding member 505 around leg 501.

In one exemplary embodiment, each of the flexible pole members 504 is formed of flexible-pole member sections that are hinged at a mid-span folding fitting 600 (FIG. 6) to permit upward folding of a flexible-pole member section (i.e., flexible-pole member section 504*a*-2 in FIG. 5A) and downward folding of a flexible-pole member section (i.e., flexible-pole member section 504*a*-1 in FIG. 5A) between a raised, erect position and a folded, or lowered, position of frame structure 500. That is, to fold frame structure 500 from the raised, erect position to the folded, or lowered, position, camlock fittings 509 of each of sliding members 505 are released and the sliding members 505 are respectively repositioned down a leg 501. As sliding members 505 are repositioned downward along a leg 501, link members 502*a*-502*d* operate in a well-known scissors joint manner to bring legs 501*a*-501*d* toward each other in a well-known manner. Each flexible pole member 504*a*-504*d* is pivotally folded at mid-span folding fitting 600 so that the section of the flexible-pole member coupled to the sliding fitting is oriented upwardly and the section of the flexible-pole member coupled to central hub member (or peak-folding fitting) 700 is oriented downwardly toward to the ground. Each of the sections of the flexible-pole members coupled to the central hub member 700 is pivotally repositioned so that central hub member 700 is in the vicinity of the bottom of legs 501 when in the folded or lowered position. In one exemplary embodiment, the lower sections of legs 501*a*-501*d* are unlocked from a long, telescoped position and slid into the upper sections of the legs and locked. In the folded or lowered position, legs 501*a*-501*d* of frame structure 500 are unlocked from a long, telescoped position and slid into the upper sections of the legs and locked. In the raised position, flexible pole members 504 are able to deflect outwardly to absorb downward forces exerted on canopy (not shown) coupled to roof structure 503.

FIG. 6 depicts an isometric view of an exemplary embodiment of a mid-span folding fitting 600 for a flexible member according to the subject matter disclosed herein. Mid-span folding fitting 600 comprises two side members 601 and two pivot pins 602. Each side member 601 comprises spring-tab members 603*a* and 603*b*. As depicted in FIG. 6, flexible-pole member sections 104*a*-1 and 104*a*-2 respectively comprise ferrule members 604*a* and 604*b* that are respectively fixedly fastened in a well-known manner to one end of flexible-pole member sections 104*a*-1 and 104*b*-2. Each ferrule member 604 is pivotally attached in a well-known manner to side members 601 by a pivot pin 602. Ferrule members 604 each comprise at least one protuberance (not shown) that in operation engages a spring-tab member 603. The protuberance operates to lock a flexible-pole member section along a longitudinal axis 605 of mid-span folding fitting 600. When a force is applied to a flexible-pole member section 104 so the flexible-pole member section rotates about an axis formed by a pivot pin 602, the protuberances are released by spring-tabs 603 and mid-span folding fitting 600 forms a hinge mechanism that allows flexible-pole members 104*a*-1 and 104*a*-2 to fold towards each other. It should be understood that another exemplary embodiment of mid-span folding fitting could comprise side members that are fastened together along one side, thereby allowing the flexible-pole members to pivot without interference. It should also be understood that while FIG. 6 depicts mid-span folding fitting 600 coupled to flexible-pole member sections 104*a*-1 and 104*a*-2, mid-span folding fitting 600 could be coupled to flexible-pole members of other exemplary embodiments of the subject matter disclosed herein.

FIG. 7 depicts an isometric view of an exemplary embodiment of a central hub, or peak-folding fitting, 700 for flexible members according to the subject matter disclosed herein. Central hub 700 comprises a body member 701 and four pivot pins 702, of which only two pivot pins are visible. In one exemplary embodiment, body member 701 is configured in a cross, or X, shape and includes at least one spring-tab member 703 formed into body member 701 along each projection of the cross shape. As depicted in FIG. 7, flexible-pole members 104*a*-104*d* respectively comprise ferrule members 704*a*-704*d* that are respectively fixedly fastened in a well-known manner to one end of flexible-pole member sections 104*a*-104*d*. Each ferrule member 704 is pivotally attached in a well-known manner to body member 701 by a pivot pin 702. Ferrule members 704 each comprise at least one protuberance (not shown) that in operation engages a spring-tab member 703. The protuberance operates to lock a flexible-pole member section along a first longitudinal axis 705 or a second longitudinal axis 706 of central hub 700. When a force is applied to a flexible-pole member section 104 so the flexible-pole member section rotates about an axis formed by a pivot pin 702, the protuberances are released by spring-tabs 703 and central hub 700 forms a hinge mechanism that allows flexible-pole members 104*a*-1 and 104*a*-2 to fold towards each other. It should be understood that while FIG. 7 depicts central hub 700 coupled to flexible-pole member sections 104*a*-104*d*, central hub 700 could be coupled to flexible-pole members of other exemplary embodiments of the subject matter disclosed herein.

It should be understood that the frame structure disclosed herein is suitable for use with a canopy, which could be mounted on the disclosed frame structure in a well-known manner to for a quick erectable canopy shelter.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A frame structure, comprising:

a plurality of leg members, each leg member comprising a first end and a second end;

a top-corner fitting attached to the first end of each leg member, the top-corner fitting comprising a guide member;

a slide fitting coupled to each leg member and being adjustably movable along a length of the leg member between the first end and the second end of the leg member; and a plurality of flexible-pole members, each flexible-pole member corresponding to a leg member, each flexible-pole member comprising a first end, a second end and a flexible-pole section extending between the first end and the second end, the first end of each flexible-pole member being coupled to a corresponding slide fitting, the second end of each flexible-pole member being coupled to a central hub member and the flexible-pole section being received by the guide member of the top-corner fitting, the flexible-pole section moving past the top-corner fitting through the guide member in a direction from the second end of the flexible-pole member toward the first end of the flexible-pole member as the frame structure is unfolded from a folded position to an erect, unfolded position, and each flexible-pole member forming an arching shape when the frame structure is in the erect, unfolded position.

2. The frame structure according to claim 1, the guide member operating to keep the flexible-pole section of a corresponding flexible-pole member in a correct position as the frame structure is unfolded into an erect position.

3. The frame structure according to claim 2, wherein the guide member comprises an orifice that receives the flexible-pole member.

4. The frame structure according to claim 2, further comprising a plurality of link members forming an extendible perimeter assembly between the plurality of leg members.

5. The frame structure according to claim 2, wherein at least one of the flexible-pole member comprises a plurality of flexible-pole member sections.

6. The frame structure according to claim 5, wherein the flexible-pole member sections forming a flexible-pole member are coupled together by a mid-span folding fitting.

* * * * *